US009916787B2

(12) United States Patent
Zheng et al.

(10) Patent No.: US 9,916,787 B2
(45) Date of Patent: Mar. 13, 2018

(54) CONTENT DRIVEN OVERDRIVE FOR DISPLAY DEVICES

(71) Applicant: Apple Inc., Cupertino, CA (US)

(72) Inventors: Fenghua Zheng, San Jose, CA (US); Paolo Sacchetto, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 42 days.

(21) Appl. No.: 15/060,323

(22) Filed: Mar. 3, 2016

(65) Prior Publication Data

US 2016/0275850 A1 Sep. 22, 2016

Related U.S. Application Data

(60) Provisional application No. 62/135,117, filed on Mar. 18, 2015.

(51) Int. Cl.
*G09G 3/20* (2006.01)
*G09G 3/32* (2016.01)

(52) U.S. Cl.
CPC ..... *G09G 3/32* (2013.01); *G09G 2310/0248* (2013.01); *G09G 2310/0275* (2013.01); *G09G 2320/0285* (2013.01)

(58) Field of Classification Search
CPC ..... G09G 3/32; G09G 2310/0248; G09G 2320/0285; G09G 2310/0275
See application file for complete search history.

(56) References Cited

U.S. PATENT DOCUMENTS

| | | | | |
|---|---|---|---|---|
| 6,850,218 | B2 | 2/2005 | Waterman | |
| 7,202,858 | B2 | 4/2007 | DeGroot et al. | |
| 7,764,256 | B2 * | 7/2010 | Huang | G09G 3/3611 345/690 |
| 8,248,339 | B2 * | 8/2012 | Lomas | G09G 3/3611 345/100 |
| 8,299,991 | B2 * | 10/2012 | Boiko | G09G 3/3648 345/87 |
| 8,969,774 | B2 | 3/2015 | Johansson | |
| 2007/0290964 | A1 * | 12/2007 | Yang | G09G 3/3648 345/87 |
| 2015/0325217 | A1 * | 11/2015 | Lee | G09G 3/3648 345/545 |

* cited by examiner

*Primary Examiner* — Andrew Sasinowski
(74) *Attorney, Agent, or Firm* — McDermott Will & Emery LLP

(57) ABSTRACT

This application sets forth systems, methods, and apparatus for improving charge settling times for lines and pixels of a display panel. The charge settling times are improved by providing an over drive signal and a bias current to a line and/or pixel of the display panel based a comparison of content data to be output by the display panel. In this way, by initially charging the line and/or pixel with the over drive signal, the line and/or pixel can be fully charged more quickly in display panels that operate at higher refresh rates.

20 Claims, 9 Drawing Sheets

400

| CONTENT DATA DIFFERENCE | PIXEL | PERCENTAGE OVER DRIVE |
|---|---|---|
| Delta_0 | N | Percentage_0 |
| Delta_1 | | Percentage_1 |
| Delta_2 | | Percentage_2 |
| Delta_3 | | Percentage_3 |
| ⋮ | ⋮ | ⋮ |
| Delta_x | N+x | Percentage_x |

*FIG. 4A*

402

| CONTENT DATA DIFFERENCE | PIXEL | OVER DRIVE PERIOD |
|---|---|---|
| Delta_0 | N | Period_0 |
| Delta_1 | | Period_1 |
| Delta_2 | | Period_2 |
| Delta_3 | | Period_3 |
| ⋮ | ⋮ | ⋮ |
| Delta_x | N+x | Period_x |

*FIG. 4B*

CONTENT DRIVEN OVERDRIVE FOR DISPLAY DEVICES

CROSS-REFERENCE TO RELATED APPLICATION

The present application claims the benefit of U.S. Provisional Application No. 62/135,117, entitled "CONTENT DRIVEN OVER DRIVE FOR DISPLAY DEVICES," filed Mar. 18, 2015, the content of which is incorporated herein by reference in its entirety for all purposes.

FIELD

The described embodiments relate generally to display devices. More particularly, the present embodiments relate to providing an over drive signal to a display line in order to improve charge settling times for the line and/or a pixel.

BACKGROUND

Recent advances in display technology have led to the generation of some of the fastest display devices in recent times. However, with the advancement of such displays comes a substantial amount of processing power in order to ensure that data is accurately presented on the display device. Depending on the refresh rate of the display device, the presentation of data can be difficult given the voltage and current requirements for each line of the display device to be adequately charged. If a line is not adequately charged during the presentation of data, display artifacts may be apparent, which can diminish the user experience. This issue may be exacerbated in higher resolution displays where there are more lines, and therefore more opportunities for data to be inaccurately presented on the display.

SUMMARY

This paper describes various embodiments that relate reducing charge settling time for lines and pixels of display panels. In some embodiments, a method is set forth for reducing a charge settling time exhibited by a line of a display panel using content data provided to the display panel. The method can include a step of providing a non-linear over drive signal to the line of the display panel. The non-linear over drive signal can be based on a difference between bits of the content data corresponding to different lines of the display panel. In some embodiments, amplitude and/or a period of the non-linear over drive signal is based on the difference between the bits of the content data. Additionally, in some embodiments, amplitude and/or period are selected from a look up table that includes values corresponding to differences between bits of content data.

In other embodiments, a display driver is set forth. The display driver can include at least one input configured to receive first content data and second content data that each corresponds to display data to be output by a display panel. The display driver can further include at least one output configured to provide an over drive signal to a line of the display panel. Furthermore, the display driver can include a display logic configured to i) determine a difference between the first content data and the second content data and ii) calculate at least one parameter for the over drive signal based on the difference between the first content data and the second content data. In some embodiments, the display driver can include a memory connected to the display logic and configured to store at least one look up table that defines a correspondence between the i) at least one parameter for the over drive signal and ii) the difference between the first content data and the second content data.

In yet other embodiments, a display panel is set forth. The display panel can include a light emitting diode (LED) matrix configured to provide an output based on content data received by the display panel. The display panel can further include a display driver connected to the LED matrix. Incorporated into the display driver can be a display logic configured to perform a comparison of the content data and provide an over drive signal to a line of the LED matrix based on the comparison of the content data.

Other aspects and advantages of the invention will become apparent from the following detailed description taken in conjunction with the accompanying drawings which illustrate, by way of example, the principles of the described embodiments.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The disclosure will be readily understood by the following detailed description in conjunction with the accompanying drawings, wherein like reference numerals designate like structural elements.

FIGS. 4A and 4B illustrate look up tables that can be used to determine percentage over drive and over drive period for an output signal of a display driver.

DETAILED DESCRIPTION

Figure 1A:
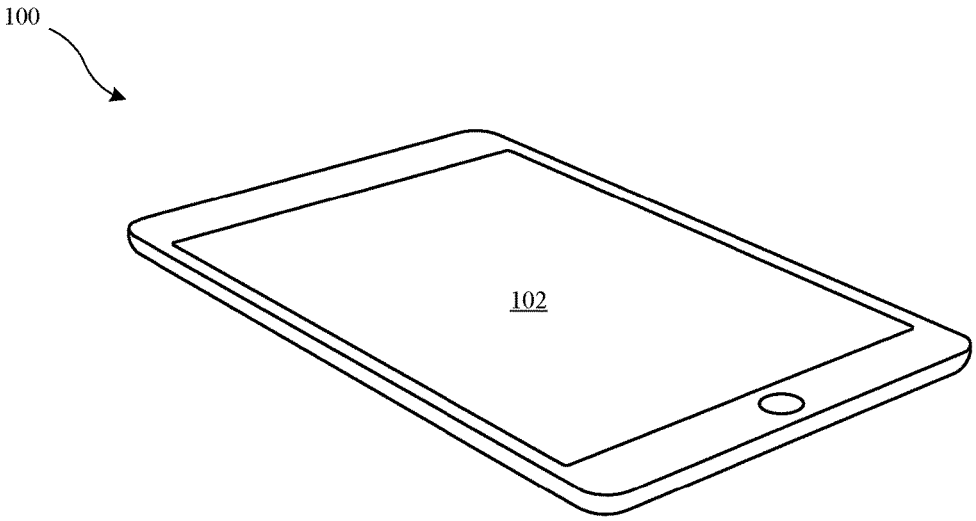
FIGS. 1A and 1B illustrate a perspective view of a display panel and a light emitting diode (LED) matrix diagram, respectively.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The embodiments discussed herein relate to apparatus, systems, and methods for improving charge settling times for lines and pixels of a display panel. In display panels operating at higher refresh rates (e.g., greater or equal to 120 hertz), the duration of time that a line or pixel is charged can be very short, making it very difficult for a line or pixel to be adequately charged fast enough for data to be displayed. In order to improve charge times, a charge settling time and slewing time for each line or pixel can be reduced be generating charge signals, such as a bias current and over drive signal, based on content data. Specifically, the embodiments relate to using content data to calculate an amount of over drive voltage and/or current that will effectively reduce a settling time and slewing time for each line and/or pixel of the display panel. By reducing the settling time and slewing time, each line and/or pixel can quickly reach an adequate level of charge for presenting content data at the display panel. In some embodiments, differences between current content data and future content data can be analyzed by a display driver or a timing controller of the display panel to provide an over drive signal and bias current to one or more data lines and/or pixels in a light emitting diode (LED) matrix to reduce charge settling times and slewing times.

An LED of the LED matrix can be configured to receive current when both the data line, corresponding to the column of the LED matrix, and the row line, corresponding to the row of the LED matrix, receives adequate charge. A row is charged by a row driver and a data line is charged by a display driver or column driver. The data line is frequently recharged by the display driver in order to illuminate LEDs in multiple rows. However, a data line can retain some charge after illuminating an LED in a row line and subsequently use some of the remaining charge to illuminate an LED in an adjacent or subsequent row line. As discussed herein, the display driver can be configured to over drive data lines depending on the content data provided to the display driver in order to improve charge settling time. Charge settling time can refer to an amount of time a line takes to reach a target voltage or charge, and content data can refer to bits of an array that determine the various levels of an analog signal that will drive the line and/or pixel. For example, the display driver can have a 6, 8, or 10 bit resolution, and the square of the resolution will determine the number of levels of analog signals (i.e., $2^8=256$). Depending on the content data, a voltage will be established at the data line according to one of the levels of analog signal defined by the data content. Therefore, the voltage at the data line will change depending on how the content data changes from row line to row line. The relationship between the voltage and the bias current needed to charge the data line can be defined by the following formula:

$$I \cdot \Delta t = C \cdot \Delta V \tag{1}$$

In formula (1), the settling time ($\Delta t$) refers to a change in settling time that the data line can take to reach a voltage or charge level corresponding to the content data. The capacitance (C) refers to the capacitance of the data line. The bias current (I) refers to a bias current at the data line that can achieve a voltage change ($\Delta V$). The voltage change ($\Delta V$) refers to a difference between an initial and final voltage at the data line. By providing additional charge to a line in the form of a over drive signal, settling time can be reduced per line.

During operation of the display driver, pixel data or content data can be used to provide a bias current and an over drive signal, as further discussed herein. The over drive signal can be based on a percentage over drive and over drive period that are each determined based on the content data. The percentage over drive can refer to a percentage above an output current or output voltage from the display drive or timing controller that will reduce the settling time of a line and/or pixel. Typically, the settling time refers to an amount of time the data line takes to reach a voltage or charge level, however, the settling time can be reduced by over driving an output current or voltage to the data line for a period of time (i.e., the over drive period). For example, by taking a difference between current content data and subsequent content data, a value for the bias current, percentage over drive, and over drive time can be calculated according to a formula and/or supplied by a look up table. Thereafter, the percentage over drive and over drive time can be used as parameters for defining an over drive signal that is provided, with the bias current, from the display driver or a timing controller to a line and/or pixel of a display panel.

In some embodiments, a data control unit coupled to a display driver or column driver, or the display driver itself, can generate a control signal for controlling the bias current, over drive percentage, and/or over drive time according to current content data and subsequent content data. The data control unit can determine the difference between a current analog signal level corresponding to the current data content and a subsequent analog signal level corresponding to subsequent content data. The difference can be based on one or more bits (e.g., a most significant bit for content data) provided to the data control unit. For example, if the subsequent content data is to have an analog signal level that is a percentage value less than the analog signal level of the current content data, the data control unit will use the percentage value to determine a modified bias current value, percentage over drive value, and over drive time value for the subsequent content data. After current content data is executed and the first row line (N) is energized, the bias current and over drive signal are adjusted according to each of the modified bias current value, percentage over drive value, and over drive time value. The adjusted bias current and adjusted over drive signal can be a different shape or amplitude than the bias current and over drive signal used for the current content data. Thereafter, the data line is charged with the adjusted bias current and adjusted over drive signal when the subsequent content data is executed. This algorithm can be applied to all rows of an LED matrix in a display panel. Upon the final row being charged and a blank period occurring before a subsequent frame is provided to the LED matrix, the bias current and over drive signal can be restored to a normal value for illuminating the LED's of the LED matrix. For example, the normal value can correspond to the maximum analog signal level or a median analog signal level for preparing the display driver for a worst case charging scenario.

These and other embodiments are discussed below with reference to FIGS. 1-9; however, those skilled in the art will readily appreciate that the detailed description given herein with respect to these figures is for explanatory purposes only and should not be construed as limiting.

Figure 1B:
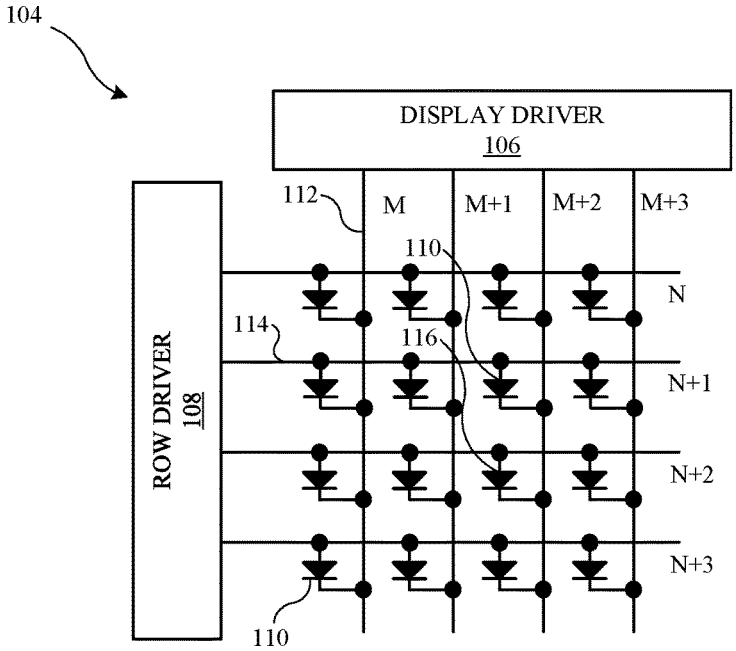

FIGS. 1A and 1B illustrate a perspective view 100 of a display panel 102 and an LED matrix diagram 104, respectively. The display panel 102 can be part of a portable computing device using an LED matrix to output light at the display panel 102. Specifically, the display panel discussed herein can refer to the display of a laptop computing device, desktop computing device, media player, cellular phone, or any other electronic device incorporating a display having LED's. FIG. 1B illustrates an LED matrix diagram 104 for use in the display panel 102, or any other suitable display device. In order to cause an LED 110 to illuminate, each data line 112 and row line 114 is individually provided electrical current. For example, in order to illuminate the LED 110 at row N+1 and column M+1, both row N+1 and column M+1 must concurrently receive electrical current. If the next LED to be illuminated is the LED 116 corresponding to row N+2 and column M+1, the display driver 106 may continue providing a bias current to column M+1 until the row driver 108 stops the current at row N+1 and provides current to N+2. By keeping the bias current at column M+1, the display driver 106 is prepared to assist in illuminating other LED's. In order to ensure that the charge supplied to each row and/or column is adequate, the display driver can provide an over drive signal according to a particular percentage value and a particular over drive time based on content data. The over drive signal can be a non-linear voltage signal that has a voltage greater than an initial voltage exhibited by the bias current. Each of the over drive signal and the bias current can be based on content data received by the display driver. By providing the over drive signal simultaneous with or before the bias current, a charge settling time for the lines and pixels of the LED matrix can be reduced while also making a more efficient use of power. Reducing settling times is important for displays having shorter line durations (e.g., displays operating at a refresh rate of at least 120 hertz (Hz)) because the fast rate at which frames of data are cycled at such displays causes a greater demand for charge.

Figure 2:
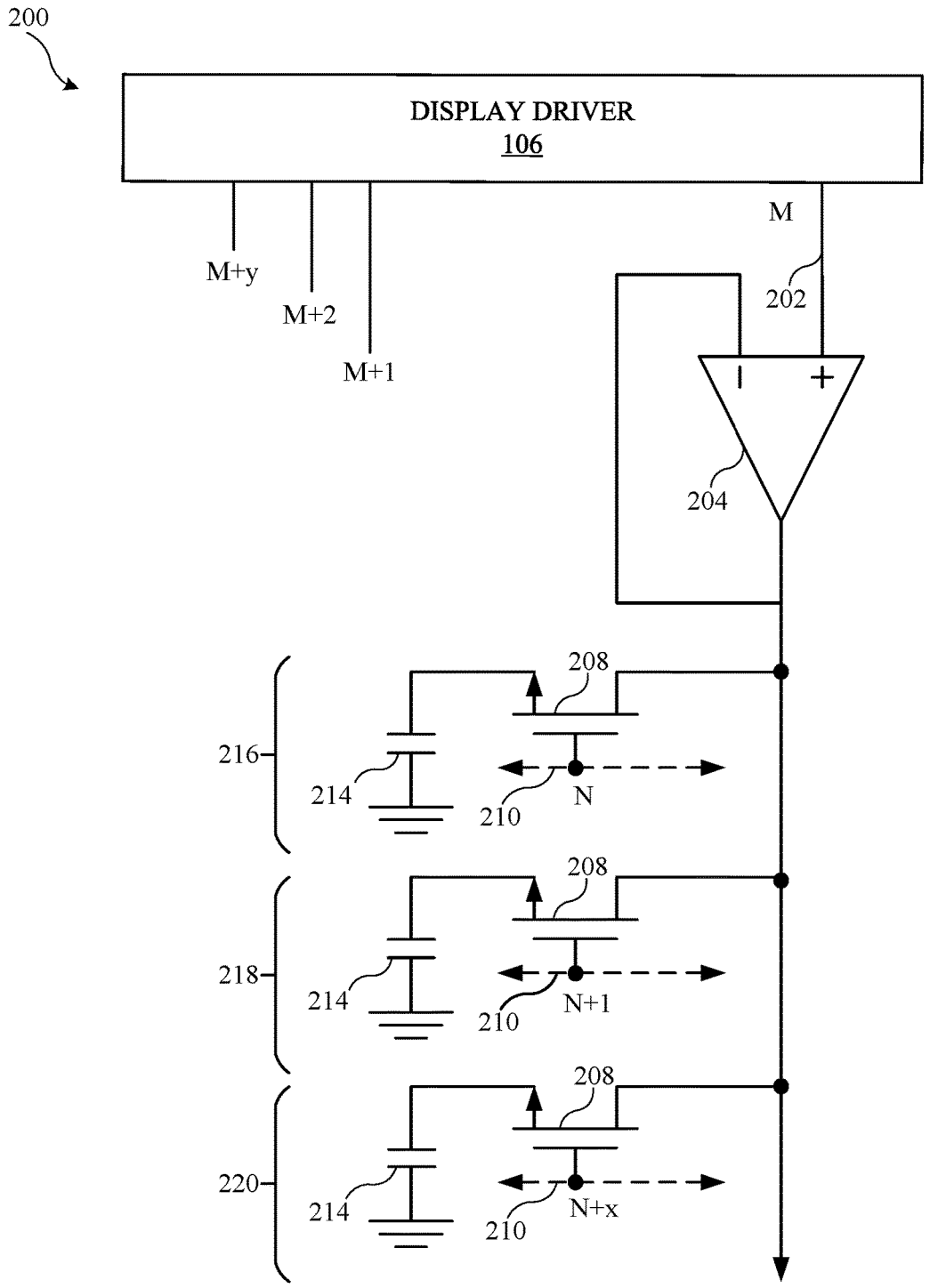
FIG. 2 illustrates a diagram of a display driver configured to provide an over drive signal and bias current to one or more data lines based on content data to be presented at a display that includes the display driver.

FIG. 2 illustrates a diagram 200 of a display driver 106 configured to provide an over drive signal and bias current to one or more data lines based on content data to be presented at a display that includes the display driver 106. The display driver 106 can be electrically coupled to one or more data lines 202 (e.g., M, M+1, M+1, M+2, M+y, and so on for y>1). The output of the display driver 106 can be an over drive signal and a bias current, which can be buffered in the data line buffer 204 prior to reaching each of the transistors 208. Each of the transistors 208 are connected to the data line 202 at a portion of the data line corresponding to a row of an LED matrix, in which the display driver 106 can be electrically coupled to. For example, a transistor 208 is coupled at the first row 216, second row 218, and third row 220, in order to allow or prevent charge from being received at each storage capacitor 214. The storage capacitors 214 store a pixel voltage, which is used to control the LED current at each row and column. Each transistor 208 can be electrically coupled to a row driver or other device suitable for providing current to the LED's in each row line 210 (e.g., N, N+1, N+x, and so on for x>1) according to the content data to be displayed at the display panel 102.

In some embodiments, the display driver 106 can operate to adjust a voltage and/or current of an individual data line 202. In other embodiments, the display driver 106 can be divided into several sections (e.g., 4 sections). In this way, each section has its own over drive signal and bias current settings in order to accomplish the over driving and power saving scheme discussed herein without having to manage a larger number of data lines 202. For example, a 960-channel display driver 106 can be divided into four 240-channel sections, so that each 240-channel section can have its own bias current generation circuit. Thereafter, the maximum level of each 240-channel section can be used to set the bias current for that 240-channel section.

Figure 3A:
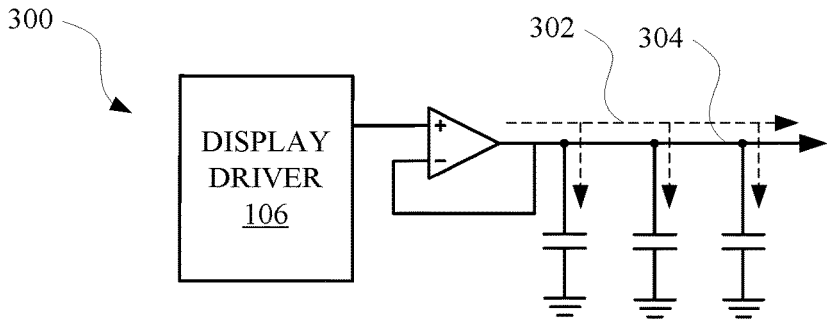
FIGS. 3A and 3B illustrate the over drive signal and bias current provided to a line of a display panel by the display driver and a plot of how settling time of a line charge and/or pixel charge is improved by providing the over drive signal and the bias current.
Figure 3B:
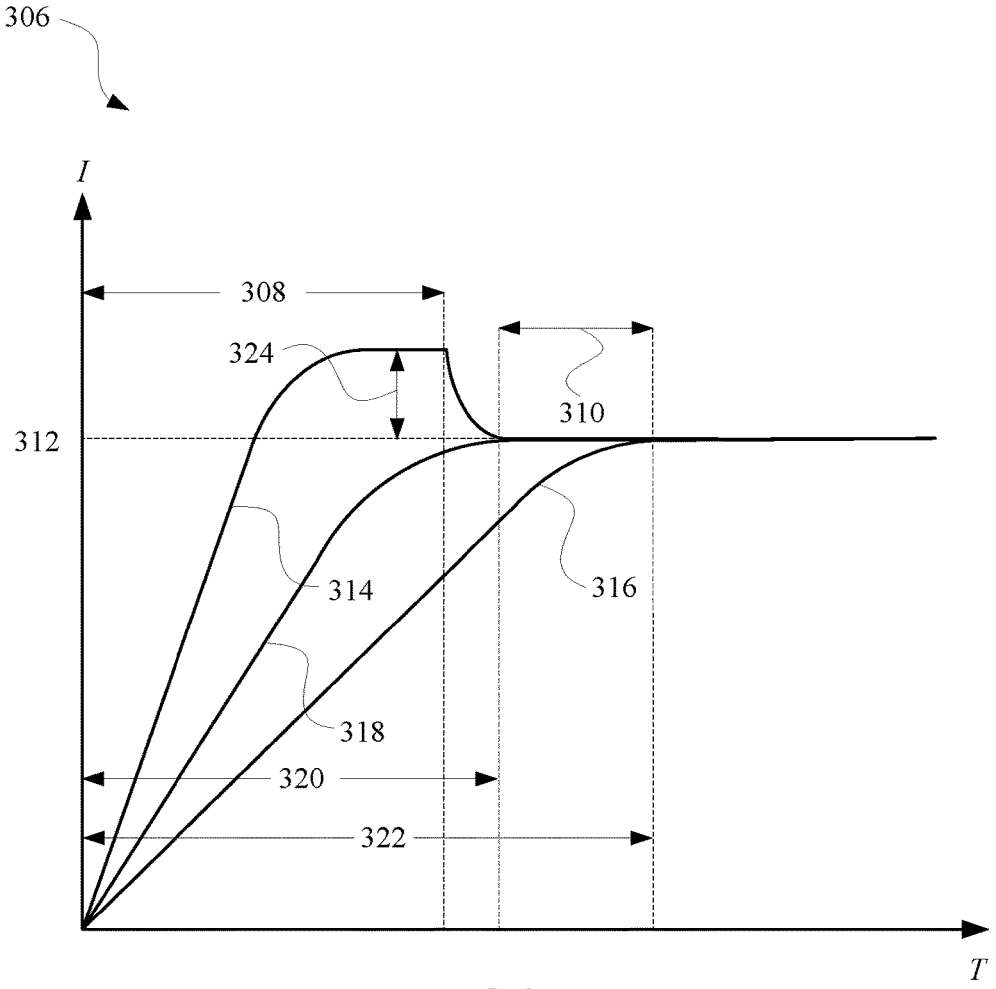

FIGS. 3A and 3B illustrate an output 302 provided to a line 304 of a display panel by the display driver 106 and a plot 306 of how settling time of a line charge and/or pixel charge is improved by providing the output 302 as an over drive signal and a bias current. Specifically, FIG. 3A illustrates the output 302 that is provided by the display driver 106 to different lines of the display panel. Because the output 302 is distributed over multiple lines, the output 302 must include adequate charge so that each line can accurately present data at the display panel. FIG. 3B illustrates the plot 306 of charge settling with and without over drive being provided to a line of a display panel. For example, settling period 322 corresponds to a charge settling time for a line and/or pixel that has been provided a non-over driven signal 316. Although a display panel may still operate using the non-over drive signal 316, the settling period 322 can be reduced by providing an over drive signal 314 for an over drive period 308. As a result of the over drive signal 314 initially entering the line and/or pixel, the settling period 322 can be reduced, for example, by a period 310, thereby resulting in a reduced settling period 320.

Content data can be used to calculate parameters for generating the over drive signal 314. The parameters of the over drive signal 314 can include a percentage over drive 324, which corresponds to a percentage increase or decrease of an amplitude of the over drive signal compared to a previous over drive signal, a default over drive signal output by the display driver, or a bias current. Additionally, the parameters of the over drive signal 314 can also include an over drive period 308, which corresponds to the amount of time that the over drive signal 314 is applied to the line and/or pixel. The percentage over drive 324 and over drive period 308 can be static or dynamic values. Additionally, each of the percentage over drive 324 and over drive period 308 can change per line and/or pixel, based on the content data corresponding to each line and/or pixel. For example, the percentage over drive 324 and over drive period 308 for a line of a display panel can be greater or less than corresponding values of percentage over drive 324 and over drive period 308 for a different line of the display panel during the execution of one or more frames of data.

In some embodiments, the percentage over drive 324 and/or the over drive period 308 are determined based on values stored in one or more look up tables. For example, the look up table can include one or more values for percentage over drive 324 and/or one or more values for over drive period 308. Each of the values for percentage over drive 324 and/or over drive period 308 can correspond to a difference between content data or pixel data, or, more specifically, a difference between content data for adjacent lines of a display panel. For example, the look up table can be arranged such that the percentage over drive 324 can increase as the difference between content data increases. Additionally, the look up table can be arranged such that the over drive period 308 increases as the difference between content data increases. Furthermore, the look up table can be arranged such that the percentage over drive and/or the over drive period 308 decreases as the difference between content data decreases. However, in some embodiments, the look up table can be arranged such that the percentage over drive 324 and/or the over drive period 308 decreases as the difference between content data increases.

In some embodiments, the percentage over drive 324 and/or the over drive period 308 are determined based on one or more equations for calculating percentage over drive 324 and/or the over drive period 308. For example, in some embodiments the equation for calculating percentage over drive 324 and/or over drive period 308 can include a variable corresponding to a difference between at least two values of content data. The difference between content data can be multiplied or divided by a scaling factor in order to provide a basis for the percentage over drive 324 and/or the over drive period 308. The scaling factor can be configured such that the percentage over drive 324 increases when the difference between content data increases or becomes more positive. Additionally, the scaling factor can be configured such that the over drive period 308 increases when the difference between the content data increases or becomes more positive. In some embodiments, the scaling factor can be configured such that the over drive period 308 and/or the percentage over drive 324 decreases when the difference between the content data increases or becomes more positive. Furthermore, in some embodiments, the equation for calculating percentage over drive 324 and the over drive period 308 can include multiple scaling factors such that the percentage over drive 324 is calculated differently than the over drive period 308. Additionally, in some embodiments, the equation and/or look up table can be arranged such that a particular value for percentage over drive and/or over drive period can correspond to multiple different values of a difference between content data.

FIGS. 4A and 4B illustrate look up tables that can be used to determine percentage over drive and over drive period for an output signal of a display driver. Specifically, FIG. 4A illustrates an example of a look up table 400 for determining a percentage over drive for the output signal of the display driver based on a content data difference and, optionally, a pixel to be charged by the output signal. The output signal can refer to a bias current and over drive signal provided to a line of a display panel by the display driver. The look up table 400 can include an optional pixel column and the values in the pixel column can refer to a position of a pixel on the line to be charged or a total number of pixels to be charged. For example, pixel N can refer to a pixel closest to the display driver or the first pixel that the display driver charges when outputting the output signal. The pixel N+x can refer to the furthest pixel from the display driver or the last pixel that the driver charges when outputting the output signal. The look up table 400 can include a column for values of content data difference as indicated by variables "Delta_0" through "Delta_x", which correspond to a smallest or no content difference to a largest content difference, respectively. Similarly, the look up table 400 can include a column for values of percentage over drive as indicated by "Percentage_0" through "Percentage_x", which correspond to a smallest or no percentage over drive change to a largest percentage over drive change, respectively.

FIG. 4B illustrates an example of a look up table 402 for determining an over drive period for the output signal of the display driver based on a content data difference and, optionally, a pixel to be charged by the output signal. Look up table 402 can be further understood in view of the discussion of FIG. 4A. For example, the look up table 402 can include a column for values of content data difference as indicated by variables "Delta_0" through "Delta_x", which correspond to a smallest or no content difference to a largest content difference, respectively. Similarly, the look up table 402 can include a column for values of over drive period as indicated by "Period_0" through "Period_x", which correspond to a smallest or no over drive period through a largest over drive period, respectively.

Look up tables 400 and 402 can be stored by a display device or computing device connected to the display device. Additionally, the look up tables 400 and 402 can be accessed by the display driver or a display logic connected to the display driver, as further discussed herein. For example, the display logic can be configured to determine the content data difference between content data corresponding to adjacent or non-adjacent lines respectively. If the display logic is configured to use look up tables 400 and/or 402, the display logic will determine the content data difference and the pixel to be charged. Based on the values for content data difference and pixel to be charged, the display logic can determine the percentage over drive and/or the over drive period. For example, if the pixel N is to be charged and the content data difference corresponds to Delta_3, the output signal of the display driver will have a percentage over drive of Percentage_3 and an over drive period of Period_3. It should be noted that each pixel can have one or more corresponding content data difference values, percentage over drive values, and/or over drive period values provided in one or more look up tables.

Figure 5A:
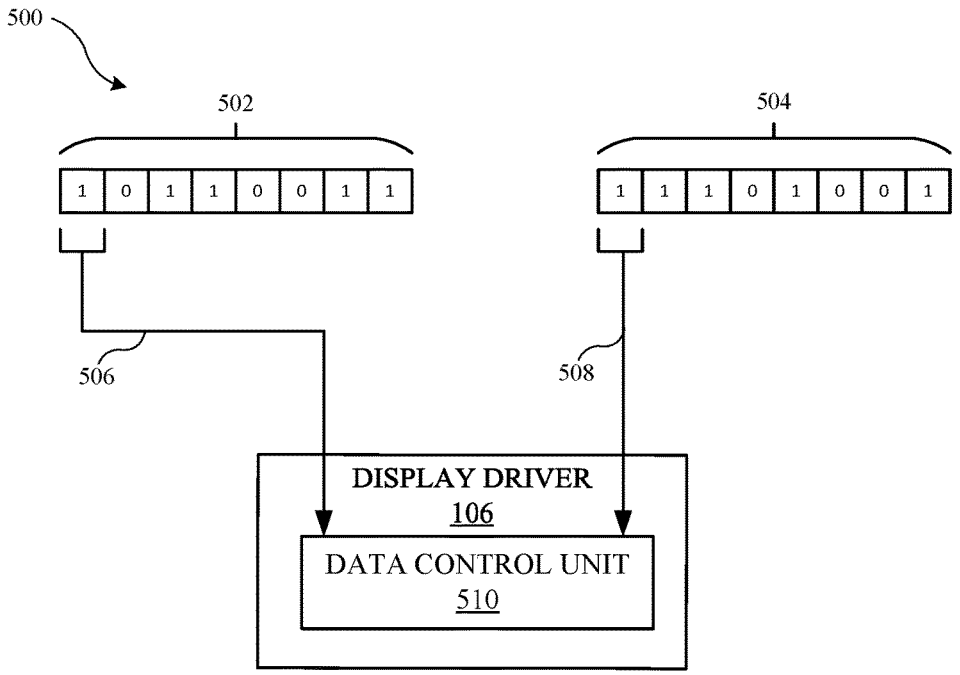
FIGS. 5A and 5B illustrate block diagrams and for calculating content data difference using bits of data.
Figure 5B:
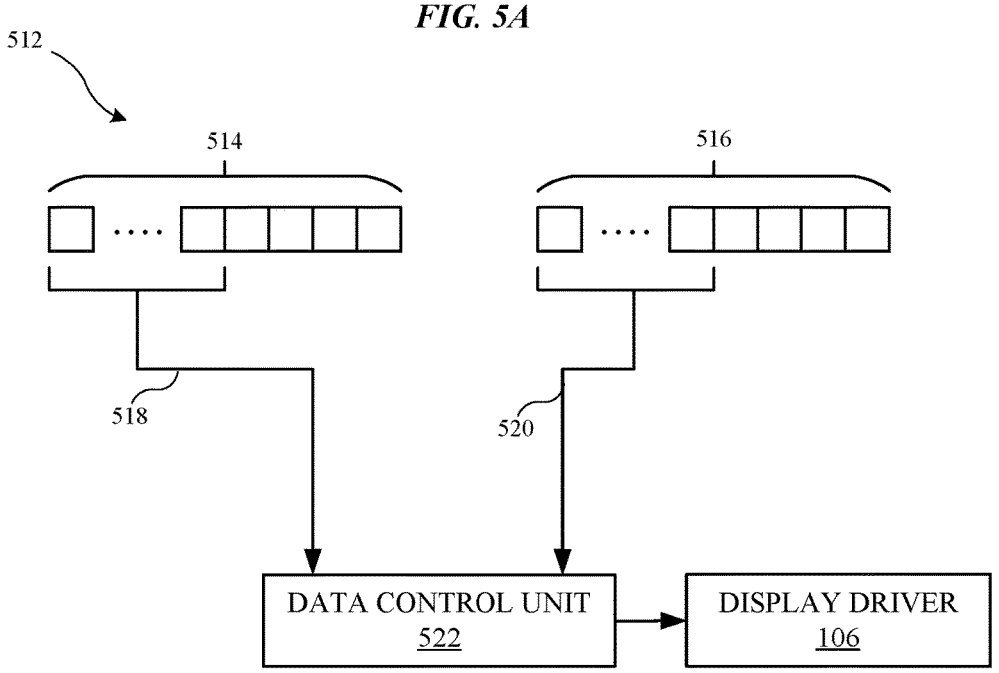

FIGS. 5A and 5B illustrate block diagrams 500 and 512 for calculating content data difference using bits of data. The content data difference can thereafter be used to determine a percentage over drive and over drive period. Specifically, FIG. 5A illustrates a block diagram 500 of a data control unit 510 receiving content data bits corresponding to analog signal levels that the display driver 106 can output for a particular pixel in a particular line. In some embodiments, the data control unit 510 can receive a first most significant bit (MSB) 506 and a second MSB 508. The first MSB 506 can correspond to first content data 502 and the second MSB 508 can correspond to second content data 504 to be executed subsequent to the first content data 502. FIG. 5A provides an example where the first MSB 506 and second MSB 508 have the same MSB's (in this example, an MSB equal to 1). In order to determine the bias current, percentage over drive, and over drive period, the data control unit 510 will compare at least the MSB 506 and the second MSB 508. Because the first MSB 506 and second MSB 508 are the same, the voltage difference is less than half of the full scale of analog signal levels. In this case, a bias current can be reduced (e.g., reduced by approximately 50%) from the previous bias current value used to charge the data line for the first content data 502. Therefore, after the first content data 502 is executed, charge settings for the second content data 504 are used to charge a data line. The charge settings for the second content data 504 are based on the bias current, percentage over drive, and the over drive period, which can be derived using one or more equations or look up tables as further discussed herein. For example, once the content data difference between first content data 502 and second content data 504 is determined, the content data difference can be included as a variable in one or more equations for deriving percentage over drive and over drive period. In some embodiments, once the content data difference between the first content data 502 and the second content data 504 is determined, the content data difference can be found in a look up table in order to identify the appropriate percentage over drive and over drive period. This process can continue for each subsequent content data until the end of a frame of content data. When a blank period is reached, corresponding to when the next frame is to be displayed at the display panel, the bias current can be restored so the data line can be charged in order to prepare for the content data in the next frame.

FIG. 5B illustrates block diagram 512 for calculating content data difference using bits of data. The content data difference can thereafter be used to determine a bias current, percentage over drive, and over drive period. Specifically, FIG. 5B illustrates the data control unit 522 comparing sets of two or more bits from each of the first content data 514 and the second content data 516. In some embodiments, each of the first content data 514 and the second content data 516 can be less than, equal to, or greater than 8-bits. Additionally, the data control unit 522 can be an entity in hardware or software that is external to the display driver 106, as illustrated in FIG. 5B. When comparing the sets of two or more bits, the data control unit 522 will determine the change in output voltage or analog signal level indicated by the differences in the sets of two or more bits from each of the first content data 514 and the second content data 516. For example, if there is a 20% change in output voltage, then the bias current corresponding to the second content data 516 can be set to 20% of the normal value. In some embodiments, any suitable percentage change in voltage can be used to adjust the bias current and over drive signal in order to save power and reduce settling times. In other embodiments, the percentages can be set according to a few set values separated by a fixed voltage change interval (e.g., 50% and 100%; or 25%, 50%, 75%, and 100%). Using four intervals, 0-25% voltage change will result in a 25% bias current; a 25-50% voltage change will result in a 50% bias current; a 50-75% voltage change will result in a 75% bias current, and a 75-100% change will result in a 100% bias current. For white, black, mosaic, or most web pages, the power savings can be 50% when only a two thresholds or intervals are used. Moreover, 75% power savings can be manifested using more intervals such as the four interval example described herein. Although the examples provided herein include two and four interval settings, it should be noted that more or less voltage change intervals corresponding to percentage changes in bias current and over drive signal can be provided. A resulting bias current can be combined with the percentage over drive and over drive period in order to create a non-linear charge signal that reduces charge settling time for a line or pixel, and reduces power consumption of a display panel.

Figure 6:
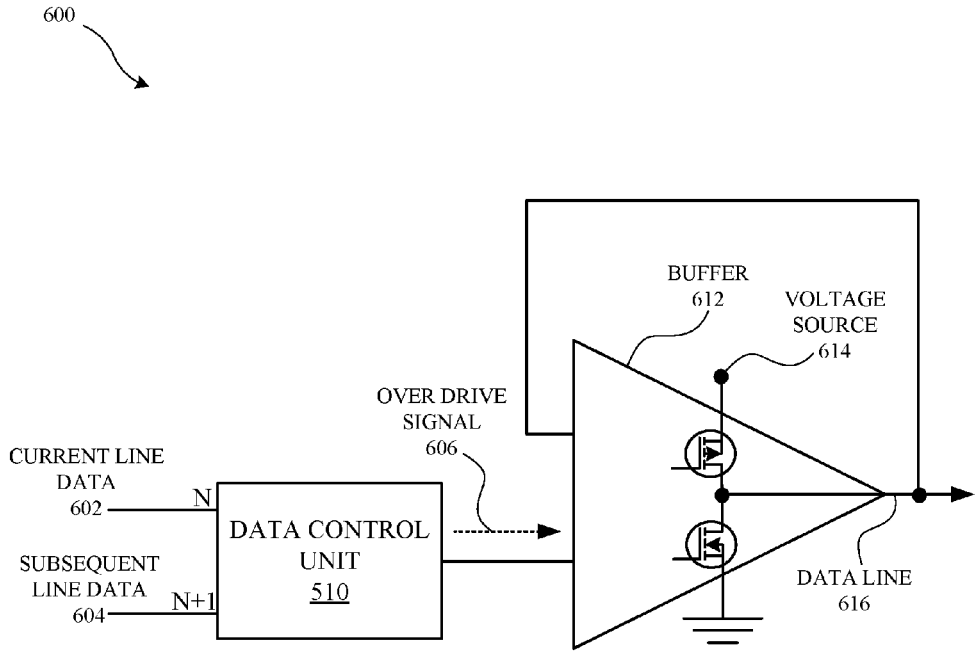
FIG. 6 illustrates a diagram for providing an over drive signal and bias current to a data line according to some embodiments discussed herein.

FIG. 6 illustrates a diagram 600 for providing an over drive signal 606 and/or bias current to a data line 616 according to some embodiments discussed herein. According to FIG. 6, the current line data 602 corresponding to row N, and the subsequent line data 604 corresponding to row N+1 are provided to the data control unit 510. Each of the current line data 602 and the subsequent line data 604 can correspond to pixel data for the LEDs associated with the data line 616 and row N and N+1, respectively. Based on a comparison between the current line data 602 and the subsequent line data 604, an over drive signal 606 and/or bias current is generated for the data line 616, as discussed herein. Thereafter, the over drive signal 606 can be provided to a buffer 612 connected to a voltage source 614 in order to buffer, amplify, or otherwise condition the over drive signal 606 for the data line 616.

Figure 7:
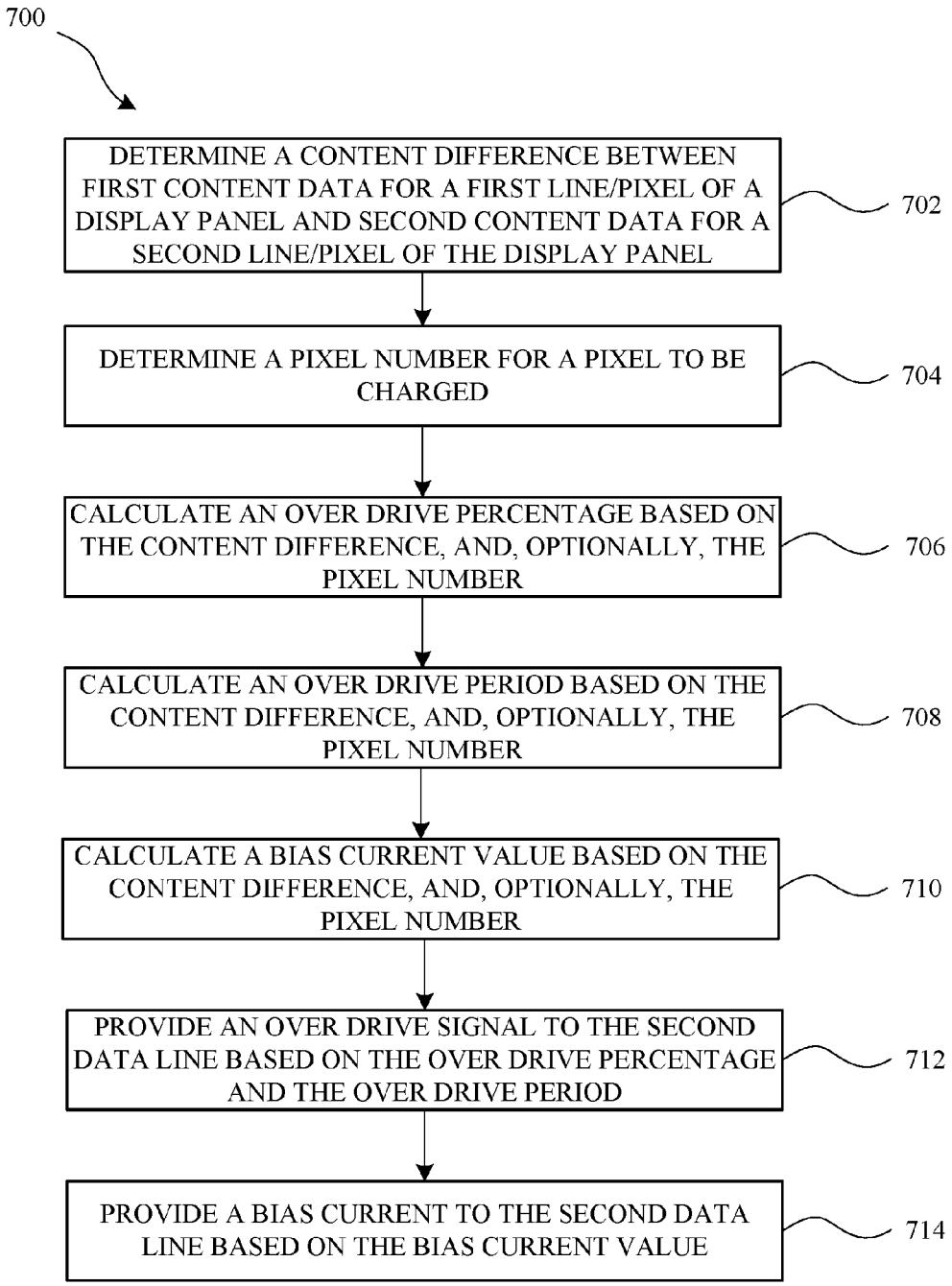
FIG. 7 illustrates a method for providing an over drive signal and a bias current to a line of a display panel based on a difference in content data to be output at different lines of the display panel.

FIG. 7 illustrates a method 700 for providing an over drive signal and a bias current to a line of a display panel based on a difference in content data to be output at different lines of the display panel. The method 700 can be performed by the data control unit 510, display driver 106, a display panel, a computing device connected to a display panel, or any suitable device or software module for controlling an output of a display panel. The method 700 can include a step 702 of determining a content difference between first content data for a first line of a display panel and second content data for a second line of the display panel. The method 700 can further include an optional step 704 of determining a pixel number for a pixel or a number of pixels to be charged. At step 706, an over drive percentage is calculated based on the content difference and, optionally, the pixel number. The method 700 can also include a step 708 of calculating an over drive period based on the content difference and, optionally, the pixel number. Each of the over drive percentage and the over drive period can be based on an equation or formula having a variable(s) for one or more of content difference, pixel number, line number, and/or any other suitable variable associated with displaying content on a display panel. At step 710, a bias current value is calculated based on the content difference and, optionally, the pixel number. Furthermore, at step 712, an over drive signal is provided to the second data line based on the over drive percentage and the over drive period. In this way, the second data line is charged with a voltage signal having a peak defined by the over drive percentage and a period of release defined by the over drive period. Thereafter, or simultaneously to step 714, a bias current is provided to the second data line based on the bias current value. In this way, the second data line can be adequately charged using both the over drive signal and the bias current. By basing the over drive signal and the bias current on the content difference and, optionally, the pixel number, charge settling time for a line and/or pixel of the display panel can be reduced. As a result, a smooth presentation of data can be provided at the display panel.

Figure 8:
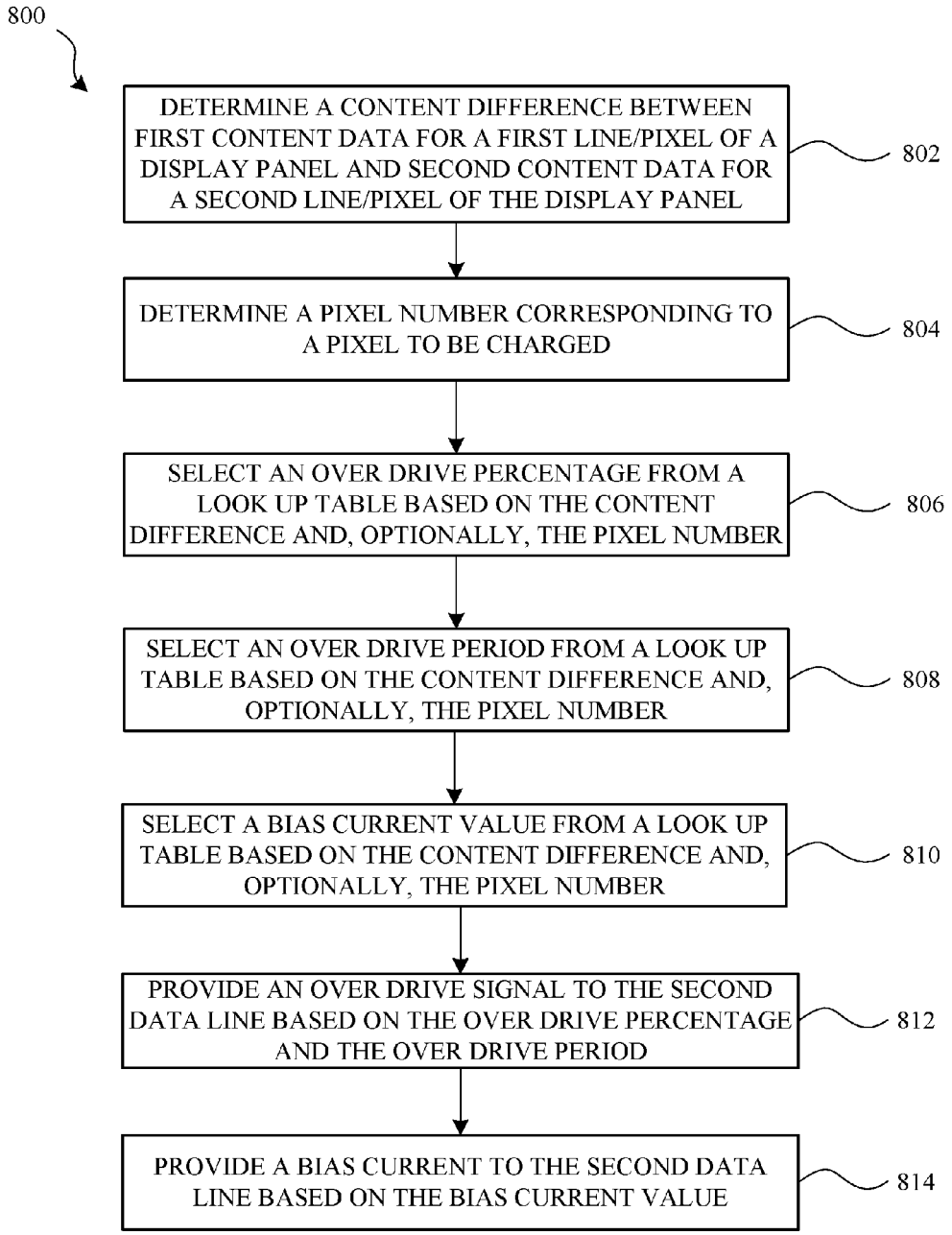
FIG. 8 illustrates a method for providing an over drive signal and a bias current to a line and/or pixel of a display panel based on a difference in content data to be output at different lines and/or pixels of the display panel.

FIG. 8 illustrates a method 800 for providing an over drive signal and a bias current to a line and/or pixel of a display panel based on a difference in content data to be output at different lines and/or pixels of the display panel. The method 800 can be performed by the data control unit 510, display driver 106, a display panel, a computing device connected to a display panel, or any suitable device or software module for controlling an output of a display panel. The method 800 can include a step 802 of determining a content difference between first content data for a first line and/or pixel of a display panel and second content data for a second line and/or pixel of the display panel. The method 800 can also include an optional step 804 of determining a pixel number corresponding to a pixel or a number of pixels to be charged. At step 806, an over drive percentage is selected from a look up table based on the content difference and, optionally the pixel number. At step 808, an over drive period is selected from a look up table based on the content difference and, optionally, the pixel number. Additionally, at step 810, a bias current value can be selected from a look up table based on the content difference and, optionally, the pixel number. It should be noted that the look up table for selecting each of the over drive percentage, over drive period, and bias current value can be the same look up table or different look up tables. Additionally, one or more of the look up tables can be stored by the data control unit 510, display driver 106, display panel, computing device, or any other suitable device having a memory suitable for storing a look up table. At step 812, an over drive signal is provided to the second data line based on the over drive percentage and the over drive period. In this way, the second data line is charged with a voltage signal having a peak defined by the over drive percentage and a period of release defined by the over drive period. Thereafter, or simultaneously to step 814, a bias current is provided to the second data line based on the bias current value. In this way, the second data line can be adequately charged using both the over drive signal and the bias current based on selections from one or more look up tables. As a result of the method 800 and the embodiments discussed herein, settling time per pixel and/or per line can be decreased by at least 20% when compared to a settling time exhibited by display devices that do not incorporate the embodiments discussed herein.

Figure 9:
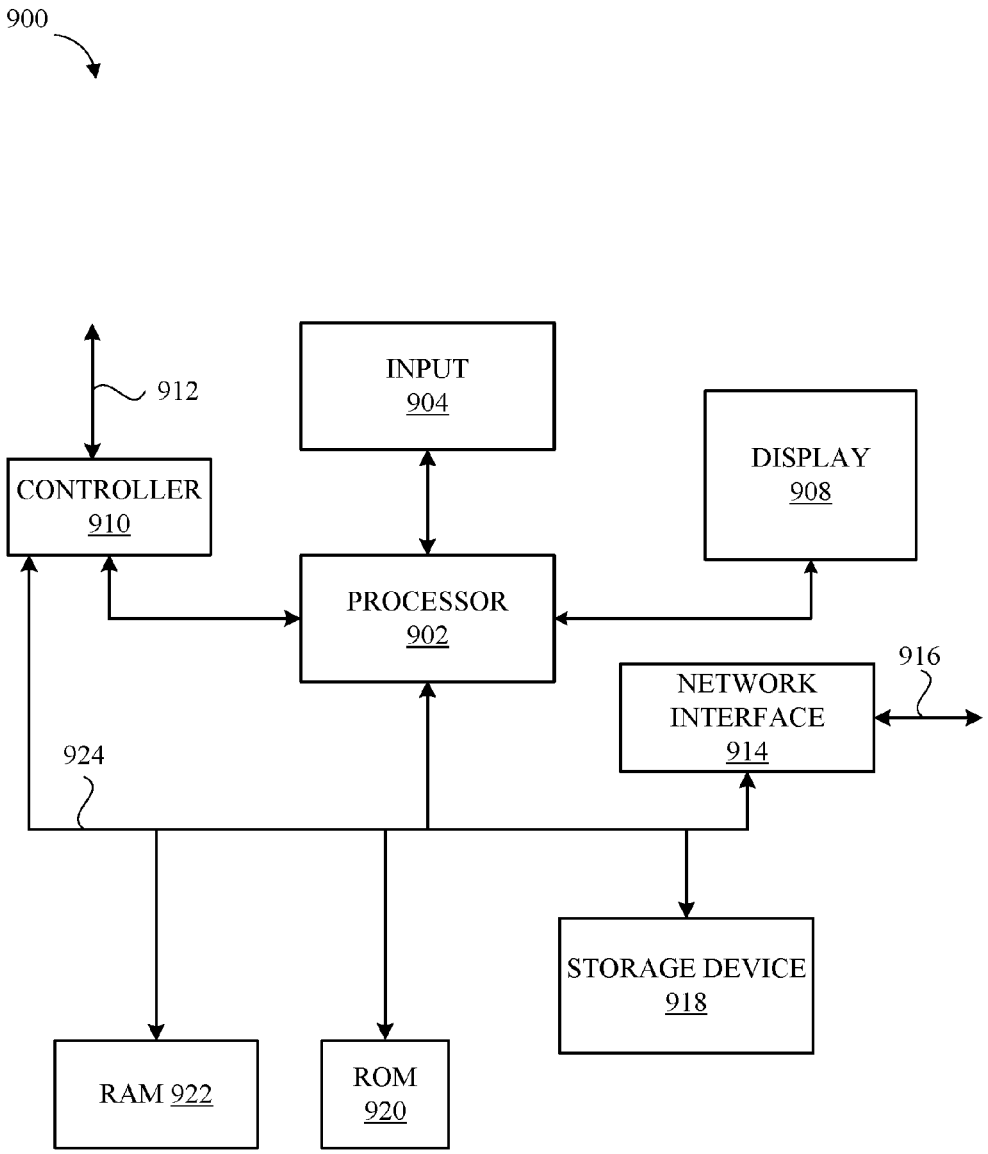
FIG. 9 is a block diagram of a computing device that can include the display panel, display driver, display logic, and/or any other device suitable for conducting the methods, processes, and steps discussed herein.

FIG. 9 is a block diagram of a computing device 900 that can include the display panel, display driver, display logic, and/or any other device suitable for conducting the methods, processes, and steps discussed herein. It will be appreciated that the components, devices or elements illustrated in and described with respect to FIG. 9 may not be mandatory and thus some may be omitted in certain embodiments. The computing device 900 can include a processor 902 that represents a microprocessor, a coprocessor, circuitry and/or a controller for controlling the overall operation of computing device 900. Although illustrated as a single processor, it can be appreciated that the processor 902 can include a plurality of processors. The plurality of processors can be in operative communication with each other and can be collectively configured to perform one or more functionalities of the computing device 900 as described herein. In some embodiments, the processor 902 can be configured to execute instructions that can be stored at the computing device 900 and/or that can be otherwise accessible to the processor 902. As such, whether configured by hardware or by a combination of hardware and software, the processor 902 can be capable of performing operations and actions in accordance with embodiments described herein.

The computing device 900 can also include user input device 904 that allows a user of the computing device 900 to interact with the computing device 900. For example, user input device 904 can take a variety of forms, such as a button, keypad, dial, touch screen, audio input interface, visual/image capture input interface, input in the form of sensor data, etc. Still further, the computing device 900 can include a display 908 (screen display) that can be controlled by processor 902 to display information to a user. Controller 910 can be used to interface with and control different equipment through equipment control bus 912. The computing device 900 can also include a network/bus interface 914 that couples to data link 916. Data link 916 can allow the computing device 900 to couple to a host computer or to accessory devices. The data link 916 can be provided over a wired connection or a wireless connection. In the case of a wireless connection, network/bus interface 914 can include a wireless transceiver.

The computing device 900 can also include a storage device 918, which can have a single disk or a plurality of disks (e.g., hard drives) and a storage management module that manages one or more partitions (also referred to herein as "logical volumes") within the storage device 918. In some embodiments, the storage device 918 can include flash memory, semiconductor (solid state) memory or the like. Still further, the computing device 900 can include Read-Only Memory (ROM) 920 and Random Access Memory (RAM) 922. The ROM 920 can store programs, code, instructions, utilities or processes to be executed in a non-volatile manner. The RAM 922 can provide volatile data storage, and store instructions related to components of the storage management module that are configured to carry out the various techniques described herein. The computing device 900 can further include data bus 924. Data bus 924 can facilitate data and signal transfer between at least processor 902, controller 910, network interface 914, storage device 918, ROM 920, and RAM 922.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium, which can be any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for reducing a charge settling time exhibited by a line of a display panel based on content data provided to the display panel, the method comprising:

at a display driver of the display panel:

providing a non-linear over drive signal to the line of the display panel, wherein the non-linear over drive signal is based on a difference between bits of the content data corresponding to different lines of the display panel.

2. The method of claim 1, wherein an amplitude of the non-linear over drive signal is based on the difference between the bits of the content data.

3. The method of claim 2, wherein the amplitude is selected from a look up table that includes values corresponding to differences between bits of content data.

4. The method of claim 1, wherein a period of the non-linear over drive signal is based on the difference between the bits of the content data.

5. The method of claim 1, wherein the bits of the content data correspond to the line that is provided the non-linear over drive signal and an adjacent line relative to the line.

6. The method of claim 1, wherein the non-linear over drive signal is a voltage signal that is provided, with a bias current, to the line of the display panel, wherein bias current is based on the difference between bits of the content data.

7. The method of claim 1, wherein display driver is configured to operate at a refresh rate of 120 hertz.

8. A display driver, comprising:

at least one input configured to receive first content data and second content data that corresponds to display data to be output, respectively, by a line of a display panel and a different line of the display panel;

at least one output configured to provide an over drive signal to the line of the display panel; and a display logic configured to i) determine a difference between the first content data and the second content data and ii) calculate at least one parameter for the over drive signal based on the difference between the first content data and the second content data.

9. The display driver of claim 8, further comprising:

a memory connected to the display logic and configured to store at least one look up table that defines a correspondence between the at least one parameter for the over drive signal and the difference between the first content data and the second content data.

10. The display driver of claim 9, wherein the at least one parameter includes an over drive percentage that defines an amount of an amplitude of the over drive signal compared to an output signal provided to the different line of the display.

11. The display driver of claim 9, wherein the at least one parameter includes an over drive period that defines an amount of time that the over drive signal is provided to the line.

12. The display driver of claim 8, further comprising:

a signal buffer configured to buffer the over drive signal.

13. A display panel, comprising:

a light emitting diode (LED) matrix configured to provide an output based on content data received by the display panel;

a display driver connected to the LED matrix, the display driver comprising:

a display logic configured to perform a comparison of the content data and provide an over drive signal to a line of the LED matrix based on the comparison, wherein the comparison comprises a comparison of a portion of the content data for the line of the LED matrix and a portion of the content data for a different line of the LED matrix.

14. The display panel of claim 13, wherein the over drive signal is a non-linear signal generated based on a difference between at least two arrays of content data.

15. The display panel of claim 13, wherein the display panel is configured to operate at a refresh rate greater than 60 hertz.

16. The display panel of claim 13, wherein the over drive signal is provided to the line in combination with a bias current that is provided by the display driver.

17. The display panel of claim 16, wherein both the over drive signal and the bias current are based on the comparison of the content data.

18. The display panel of claim 13, wherein the display logic is connected to a memory configured to store a look up table that includes parameters that define the over drive signal.

19. The display panel of claim 13, wherein the look up table includes values corresponding to percentage of over drive and a duration of over drive.

20. The display panel of claim 13, wherein the comparison of content data includes a comparison of at least two most significant bits of content data.

* * * * *